US010397711B2

(12) United States Patent
Boldt et al.

(10) Patent No.: US 10,397,711 B2
(45) Date of Patent: Aug. 27, 2019

(54) METHOD OF DETERMINING OBJECTIVE PERCEPTUAL QUANTITIES OF NOISY SPEECH SIGNALS

(71) Applicant: GN Hearing A/S, Ballerup (DK)

(72) Inventors: Jesper Bunsow Boldt, Malov (DK); Karl-Fredrik Johan Gran, Limhamn (SE); Mads Graesboll Christensen, Dronningglund (DK)

(73) Assignee: GN Hearing A/S, Ballerup (DK)

( * ) Notice: Subject to any disclaimer, the term of this patent is extended or adjusted under 35 U.S.C. 154(b) by 124 days.

(21) Appl. No.: 15/257,762

(22) Filed: Sep. 6, 2016

(65) Prior Publication Data

US 2017/0094420 A1 Mar. 30, 2017

(30) Foreign Application Priority Data

Sep. 24, 2015 (DK) ..... 2015 70608

(51) Int. Cl.
*G10L 25/60* (2013.01)
*H04R 25/00* (2006.01)

(52) U.S. Cl.
CPC ..... *H04R 25/407* (2013.01); *G10L 25/60* (2013.01); *H04R 25/405* (2013.01);
(Continued)

(58) Field of Classification Search
CPC .. H04R 25/407; H04R 25/405; H04R 25/552; H04R 2225/43; H04R 2225/55; H04R 2460/01; G10L 25/60
(Continued)

(56) References Cited

U.S. PATENT DOCUMENTS 6,075,869 A 6/2000 Killion et al.
6,704,422 B1 3/2004 Jensen
(Continued)

FOREIGN PATENT DOCUMENTS

WO WO 2005/084074 A2 9/2005
WO WO 2005/084074 A3 9/2005
(Continued)

OTHER PUBLICATIONS

J. M. Kates and K. H. Arehart, "The hearing-aid speech quality index (HASQI) version 2," Journal of the Audio Engineering Society, vol. 62, No. 3, pp. 99-117, Mar. 2014.
(Continued)

*Primary Examiner* — Sean H Nguyen
(74) *Attorney, Agent, or Firm* — Vista IP Law Group, LLP

(57) ABSTRACT

The present disclosure relates in a first aspect to a method of determining an objective perceptual quantity of a noisy speech signal using directional sound information. The method comprises steps of applying a noisy speech signal comprising a mixture of target speech and interfering noise to a first hearing instrument with an adjustable microphone arrangement and controlling the adjustable microphone arrangement to produce first and second directivity patterns exhibiting first and second directivity indexes, respectively, wherein said second directivity index is smaller than the first directivity index at one or more reference frequencies. First and second noisy speech segments are recorded from the adjustable microphone arrangement using the first and second directivity patterns, respectively, and at least one value of the objective perceptual quantity of the noisy speech signal is determined by comparing the first noisy speech segment and the second noisy speech segment.

20 Claims, 4 Drawing Sheets

(52) U.S. Cl.
CPC ..... *H04R 25/552* (2013.01); *H04R 2225/43* (2013.01); *H04R 2225/55* (2013.01); *H04R 2460/01* (2013.01)

(58) Field of Classification Search
USPC ..... 381/313
See application file for complete search history.

(56) References Cited

U.S. PATENT DOCUMENTS

| | | | | |
|---|---|---|---|---|
| 2003/0215106 | A1* | 11/2003 | Hagen | H04R 25/407 381/313 |
| 2013/0142345 | A1* | 6/2013 | Waldmann | H04R 25/70 381/56 |
| 2014/0270287 | A1 | 9/2014 | Park | |
| 2015/0348571 | A1* | 12/2015 | Koshinaka | G10L 25/60 704/245 |

FOREIGN PATENT DOCUMENTS

| | | | |
|---|---|---|---|
| WO | WO 2007/098768 | A1 | 9/2007 |
| WO | WO 20136/091703 | A1 | 6/2013 |
| WO | WO 2013/138747 | A1 | 9/2013 |

OTHER PUBLICATIONS

T. H. Falk, V. Parsa, J. F. Santos, K. Arehart, O. Hazrati, R. Huber, J. M. Kates and S. Scollie, "Objective Quality and Intelligibility Prediction for Users of Assistive Listening Devices: Advantages and limitations of existing tools," Signal Processing Magazine, IEEE, vol. 32, No. 2, pp. 114-124, Mar. 2015.

First Technical Examination dated Dec. 11, 2015 for corresponding Danish Patent Application No. PA 2015 70608, 7 pages.

Extended European Search Report dated Nov. 9, 2016 for corresponding EP Patent Application No. 16187961.4, 9 pages.

* cited by examiner

METHOD OF DETERMINING OBJECTIVE PERCEPTUAL QUANTITIES OF NOISY SPEECH SIGNALS

RELATED APPLICATION DATA

This application claims priority to and the benefit of Danish Patent Application No. PA 2015 70608, filed on Sep. 24, 2015, pending. The entire disclosure of the above application is expressly incorporated by reference herein.

FIELD

The present disclosure relates in a first aspect to a method of determining an objective perceptual quantity of a noisy speech signal using directional sound information. The method comprises steps of applying a noisy speech signal comprising a mixture of target speech and interfering noise to a first hearing instrument with an adjustable microphone arrangement and controlling the adjustable microphone arrangement to produce first and second predetermined directivity patterns exhibiting first and second directivity indexes, respectively, wherein said second directivity index is smaller than the first directivity index at one or more reference frequencies. First and second noisy speech segments are recorded from the adjustable microphone arrangement using the first and second predetermined directivity patterns, respectively, and at least one value of the objective perceptual quantity of the noisy speech signal is determined by comparing the first and second noisy speech segments.

BACKGROUND

A hearing impaired person typically suffers from a loss of hearing sensitivity which loss is dependent upon both frequency and the level of the sound in question. Thus a hearing impaired person may be able to hear certain frequencies (e.g., low frequencies) as well as a normal hearing person, but unable to hear sounds with the same sensitivity as a normal hearing individual at other frequencies (e.g., high frequencies). Similarly, the hearing impaired person may perceive loud sounds, e.g. above 90 dB SPL, with the same intensity as the normal hearing person, but still unable to hear soft sounds with the same sensitivity as the normal hearing person. Thus, in the latter situation the hearing impaired person suffers from a loss of dynamic range at certain frequencies or frequency bands. In addition to the above-mentioned frequency and level dependent hearing loss of the hearing impaired person loss often leads to a reduced ability to discriminate between competing or interfering sound sources for example in a noisy sound environment with multiple active speakers and/or noise sound sources. The healthy hearing system relies on the well-known cocktail party effect to discriminate between the competing or interfering sound sources under such adverse listening conditions. The cocktail party effect relies inter alia on spatial auditory cues from the competing or interfering sound sources to perform the discrimination based on spatial localization of the competing sound sources. Under such adverse listening conditions, the SNR of sound received at the hearing impaired individual's ears may be so low that the hearing impaired individual is unable to detect and use the spatial auditory cues to discriminate between different sound streams from the competing sound sources. This leads to a severe worsened ability to hearing and understanding speech in noisy sound environments for many hearing impaired persons compared to normal hearing subjects. There exist several common ways of addressing the problem by exploiting SNR enhancing techniques to the hearing aid microphone signal(s) such as single-channel noise reduction algorithms or fixed or adaptive beamforming algorithms to provide enhanced speech intelligibility or quality to hearing aid user. On the other hand there are many situations where the hearing aid user is able to do well without applying any advanced speech processing algorithms in the hearing aid. In these situations, it may be beneficial to avoid introducing more than a required amount of processing because the hearing aid user might not benefit from these and the advanced algorithms may introduce annoying sound artifacts.

SUMMARY

It would be advantageous to be able to detect the situations or listening conditions where the hearing aid user needs the advanced speech processing algorithms for example for noise suppression purposes to be able to understand speech and interact with other persons like normal hearing individuals.

A number of methods may be used to evaluate the intelligibility of a speech signal, e.g. when the speech signal is mixed with noise or after signal processing, e.g. using compression or noise reduction. In this context objective means using a computer algorithm without any involvement of human test persons. If human test subjects are used, the evaluation may be considered as a subjective evaluation. The use of objective measures can be divided into online, and offline applications. In online applications, the objective evaluation is an ongoing process while the signal processing or transmission of the speech signal is carried out while in offline applications, the objective evaluation is carried out after the signal processing has been applied, e.g. when a number of different settings for an algorithm have been used to process a noisy speech signal, and the engineer need to choose which of the settings to use.

Objective perceptual quantities such as speech quality and speech intelligibility measures can be categorized into two subgroups: intrusive and non-intrusive measures. With intrusive measures access to both a clean speech signal and a noisy speech signal is required. With non-intrusive measures, only access to the noisy speech signal is required. During normal on-line use of hearing aids there is, however, no access to the clean speech signal but only to the noisy speech signal. The noisy speech signal comprises a mixture of the target speech and unwanted interfering signals such as competing speech signals, music, noise, reverberation, etc. The problem with determination of objective perceptual quantities of intrusive nature caused by the unavailability of a clean speech signal, or reference signal, has been addressed and solved by the embodiments described herein. In accordance with the present methodology of determining an objective perceptual quantity of a noisy speech signal, and correspondingly adapted hearing instruments and hearing aid systems, the generation of a so-called "pseudo" clean speech signal, using directivity properties of an adjustable microphone arrangement, leads to a good estimate of the clean, e.g. target, speech signal. The good estimate of the clean speech signal allows various types of objective intrusive perceptual quantities such as objective speech intelligibility measures to be accurately determined or estimated.

A first aspect relates to a method of determining an objective perceptual quantity of a noisy speech signal using directional sound information.

The method comprising steps of:

a) applying a noisy speech signal comprising a mixture of target speech and interfering noise to a first hearing instrument, wherein said first hearing instrument comprises an adjustable microphone arrangement, b) controlling the adjustable microphone arrangement to produce a first predetermined directivity pattern exhibiting a first directivity index, c) recording a first noisy speech segment generated by the adjustable microphone arrangement using the first predetermined directivity pattern, d) controlling the adjustable microphone arrangement to produce a second predetermined directivity pattern exhibiting a second directivity index, wherein said second directivity index is smaller than the first directivity index at one or more reference frequencies, e) recording a second noisy speech segment generated by the adjustable microphone arrangement using the second predetermined directivity pattern, f) determining at least one value of the objective perceptual quantity of the noisy speech signal by a signal processor by comparing the first noisy speech segment and the second noisy speech segment.

An embodiment described herein addresses and solves the above discussed prior art problems with the lack of access to a clean speech signal in connection with the computation of objective perceptual quantity or quantities of the noisy speech signal during normal use of hearing instruments and hearing systems. At least one embodiment described herein has solved this problem by producing a so-called "pseudo" clean speech signal as an estimate of the unavailable "true" clean speech signal by exploiting spatially directional properties of the microphone arrangement of the hearing instrument. The "pseudo" clean speech signal may be estimated by recording the first noisy speech segment using the first predetermined directivity pattern adjusted to, or set to, a relatively large directivity index, i.e. producing a narrow beam width with a main lobe pointing towards a target speaker. Even though a finite level of interfering speech or other noise signal may be present in the "pseudo" clean speech signal under this condition, the residual noise level may be sufficiently small to allow accurate estimation of the sought after value of the objective perceptual quantity in question such as a STOI value as demonstrated and discussed in further detail below with reference to the appended drawings.

The comparison of the first noisy speech segment and the second noisy speech segment to determine or compute the at least one value of the objective perceptual quantity of the noisy speech signal may for example comprise correlation such as cross-correlation for example to compute the well-known short-time objective intelligibility measure (STOI).

Two objective perceptual quantities are often of significant interest in connection with the receipt, processing and amplification of speech signals in hearing instruments and hearing instrument systems: speech quality and speech intelligibility. Speech quality measures how pleasant and clear the received speech signal is. Noise, clicks, and other audible artifacts will among other things reduce the quality of the received speech signal. Speech intelligibility on the other hand measures whether the speech signal has been perceived or understood correctly by a listener such as a hearing aid user. In that connection it is important to note that speech quality and speech intelligibility are not necessarily correlated. Higher quality does not per se cause higher intelligibility or vice versa. As a matter of fact, lower speech quality exhibits higher intelligibility in some type of speech processing.

Hence, the objective perceptual quantity may in some embodiments of the present methodology comprise one or more of: a speech intelligibility measure, a speech quality measure, etc. The speech intelligibility measure may in some embodiments of the present methodology comprise a standardized objective intelligibility measure based on intrusive techniques such as a short-time objective intelligibility measure (STOI), speech transmission index (STI), articulation index (AI), etc. The speech quality measure may comprise a standardized objective speech quality measure such as a PESQ, POLQA, etc.

The first and second noisy speech segments are preferably substantially time-aligned segments of the noisy speech signal impinging on the adjustable microphone arrangement. The first and second noisy speech segments may be generated substantially simultaneously from first and second microphone signals produced by the adjustable microphone arrangement. Alternatively, the first and second noisy speech segments may be generated sequentially instead of simultaneously. The first noisy speech segment may be generated and recorded before generation and recording of the second noisy speech segment or vice versa. The first and second noisy speech segments may be derived from a beamforming algorithm applied with different parameter sets, e.g. time delay, to first and second omnidirectional microphone signals produced by the adjustable microphone arrangement in response to the noisy speech signal.

The respective values of the first directivity index and the second directivity index as discussed below refer to values measured under free field conditions of the first hearing instrument. The skilled person will understand that the respective values of the first directivity index and the second directivity index may be modified by the placement of the first hearing instrument in, or at, or on the hearing aid user's ear depending on the user's head and torso geometry and the shape/style of the hearing aid housing e.g. BTE, ITE, ITC, RIC, CIC, etc. The present methodology may naturally be carried out when the first hearing instrument is mounted in, or at, or on the hearing aid user's left or right ear.

One embodiment of the present methodology comprises further steps of:

h) activating or deactivating at least one signal processing algorithm running on a hearing aid signal processor based on the at least one value of the objective perceptual quantity; and/or adjusting a parameter value of the at least one signal processing algorithm based on the at least one value of the objective perceptual quantity, g) processing a microphone signal generated by the microphone arrangement in accordance with an active signal processing algorithm and/or the adjusted parameter value to produce a first hearing loss compensated output signal of the hearing instrument, i) reproducing the first hearing loss compensated output signal to the user's left or right ear through a first output transducer.

Properties of the hearing aid signal processor is discussed in additional detail below. Various methods of activating or deactivating the at least one signal processing algorithm running or executed on the hearing aid signal processor is discussed in further detail below with reference to the appended drawings.

The skilled person will understand that in some embodiments of the present methodology, a microphone signal generated by the microphone arrangement utilizing the second directivity index in response to the incoming noisy speech signal may be transmitted to the active signal processing algorithm(s) of the hearing aid signal processor essentially undelayed, e.g. a time delay less than 10 ms, to produce the first hearing loss compensated output signal. It is normally advantageous to minimize the time delay of the microphone signal through the hearing instrument to avoid echo effects and keep visual and auditory inputs to the hearing aid user reasonable aligned. The recording or storage of the second noisy speech segment of the noisy speech signal may be carried out parallelly to the processing of the noisy speech signal carried out by the hearing aid signal processor to produce the first hearing loss compensated output signal.

The present methodology may comprise a further step of gradually adjusting the parameter value of the at least one signal processing algorithm in accordance with values of the objective perceptual quantity. The skilled person will understand that values of the objective perceptual quantity typically varies over time tracking changing noise levels of the surrounding listening environment.

Various types of signal processing algorithms may be activated or deactivated or have parameter values adjusted in accordance with the varying values of the objective perceptual quantity. The at least one signal processing algorithm may for example comprise one of: an adjustable beamforming algorithm, an adaptive feedback cancellation algorithm, a single-channel noise reduction algorithm, a multi-channel noise reduction algorithm, a multi-channel dynamic range compression algorithm. The directivity of the adjustable microphone arrangement may be adjusted up or down by the hearing aid signal processor depending on the measured value of the standardized objective intelligibility measure such as STOI values such that a small directivity index value, e.g. smaller than 1.0 dB, is selected when the STOI value is large for example above 0.8. Conversely, the directivity of the adjustable microphone arrangement may be set to a high directivity index value, e.g. larger than 5.0 dB or 9 dB, is selected when the STOI value is small for example below 0.2.

Computations involved in carrying out the present methodology of determining the objective perceptual quantity of the noisy speech signal may in certain embodiments be distributed between two or more separate devices connected to each other via a wireless data communication link. Hence, the present methodology may comprise further steps of:

- transmitting the first noisy speech segment and the second noisy speech segment from the hearing instrument to a stationary terminal, a portable terminal or a second hearing instrument via a wireless communication link,
- recording the first noisy speech segment and the second noisy speech segment in a data memory area of the stationary terminal, portable terminal or second hearing instrument,
- determining the at least one value of the objective perceptual quantity of the noisy speech signal by a signal processor of the stationary terminal, portable terminal or second hearing instrument,
- transmitting the at least one value of the objective perceptual quantity from the stationary terminal, portable terminal or second hearing instrument to the first hearing instrument via the wireless communication link.

The stationary terminal may comprise a personal computer equipped with a suitable bi-directional wireless data communication interface allowing the personal computer to wirelessly receive the first noisy speech segment and the second noisy speech and transmitting the at least one value of the objective perceptual quantity segment back to the hearing instrument. The bi-directional wireless data communication interface may comprise a Bluetooth data interface or a Wi-Fi data interface. The portable terminal may comprise a smartphone, a tablet or remote body-worn processor with the corresponding wireless communication features and functions or the second hearing instrument may comprise the corresponding wireless communication features and functions.

The present method may comprise further steps of:

- recording the first noisy speech segment and the second noisy speech segment in a data memory of the first hearing instrument,
- determining the value of the at least one value of the objective perceptual quantity of the noisy speech signal by a signal processor of the first hearing instrument. In this manner the signal processor and memory resources of the first hearing instrument are configured to carry out all necessary computations for determining the at least one value of the objective perceptual quantity.

The second directivity index may be smaller than 2 dB at a reference frequency of 1 kHz; and the first directivity index may be larger than 4 dB, preferably larger than 5 dB, or larger than 6 dB, or even larger than 9 dB at the reference frequency of 1 kHz.

The first directivity index is preferably larger than second directivity index throughout a considerable portion of the speech frequency range to ensure good suppression of interfering speech and other noise sources in the microphone signal produced by the adjustable microphone arrangement during acquisition of the first noisy speech segment. Hence, according to one embodiment of the present methodology the first directivity index is larger than the second directivity index throughout a predetermined speech frequency range such as between 200 Hz and 5 kHz or between 500 Hz and 3 kHz. In another embodiment, the second directivity index is smaller than 2 dB between 500 Hz and 3 kHz while the first directivity index is larger than 4 dB, preferably larger than 5 dB, or larger than 6 dB, between 500 Hz and 3 kHz.

A second aspect relates to a hearing instrument comprising a hearing aid housing or shell configured for placement at, or in, a user's left or right ear. The hearing instrument further comprises an adjustable microphone arrangement configured for generating a microphone signal in response to incoming sound from a sound field surrounding the hearing instrument, where said incoming sound comprises a noisy speech signal having a mixture of target speech and interfering noise. A hearing aid signal processor of the hearing instrument is configured to executing steps of:

- controlling the adjustable microphone arrangement to produce a first predetermined directivity pattern exhibiting a first directivity index,
- recording, in a first address area of a data memory, a first noisy speech segment generated by the adjustable microphone arrangement using the first predetermined directivity pattern,
- controlling the adjustable microphone arrangement to produce a second predetermined directivity pattern exhibiting a second directivity index, wherein said second directivity index is smaller than the first directivity index at one or more reference frequencies, e) recording, in a second address range of the data memory, a second noisy speech segment generated by the adjustable microphone arrangement using the second predetermined directivity pattern, f) determining the at least one value of the objective perceptual quantity of the noisy speech signal by comparing the first noisy speech segment and the second noisy speech segment.

Signal processing functions of each of the signal processor of the portable terminal and the hearing aid signal processor may be executed or implemented by hardwired digital hardware or by one or more computer programs, program routines and threads of execution executed on a software programmable signal processor or processors. Each of the computer programs, routines and threads of execution may comprise a plurality of executable program instructions. Alternatively, the signal processing functions may be performed by a combination of hardwired digital hardware and computer programs, routines and threads of execution running on the software programmable signal processor or processors. Hence, each of the above-mentioned methodologies of comparing the first noisy speech segment and the second noisy speech segment may be carried out by a computer program, program routine or thread of execution executable on a suitable software programmable microprocessor such as a programmable Digital Signal Processor. The microprocessor and/or the dedicated digital hardware may be integrated on an ASIC or implemented on a FPGA device.

A third aspect relates to a hearing aid system comprising a first hearing instrument and one of a stationary terminal, a portable terminal and a second hearing instrument;

the first hearing instrument comprising:

a hearing aid housing or shell configured for placement at, or in, a user's left or right ear, an adjustable microphone arrangement configured for generating a microphone signal in response to incoming sound from a sound field surrounding the first hearing instrument, where said incoming sound comprises a noisy speech signal having a mixture of target speech and interfering noise, a hearing aid signal processor configured to executing steps of:

controlling the adjustable microphone arrangement to produce a first predetermined directivity pattern exhibiting a first directivity index, receiving a first noisy speech segment generated by the adjustable microphone arrangement using the first predetermined directivity pattern, controlling the adjustable microphone arrangement to produce a second predetermined directivity pattern exhibiting a second directivity index, wherein said second directivity index is smaller than the first directivity index at one or more reference frequencies, receiving a second noisy speech segment generated by the adjustable microphone arrangement using the second predetermined directivity pattern, a first wireless transmitter configured to transmit the first noisy speech segment and the second noisy speech segment to the portable terminal or the second hearing instrument via a wireless communication link;

the stationary terminal, portable terminal or the second hearing instrument comprising:

a second wireless transceiver configured to transmit and receive data through the wireless communication link, a signal processor configured to:

recording the first noisy speech segment and the second noisy speech segment in a data memory area of the portable terminal or in a data memory area of the second hearing instrument, determining at least one value of an objective perceptual quantity of the noisy speech signal by comparing the first noisy speech segment and the second noisy speech segment, transmitting the at least one value of the objective perceptual quantity from the stationary terminal, portable terminal or the second hearing instrument to the first hearing instrument via the wireless communication link.

The hearing aid system provides a distributed approach to computation of the at least one value of the objective perceptual quantity enabled by the wireless communication link allowing bi-directional exchange of data between the portable terminal and the first hearing instrument as discussed briefly above. The skilled person will understand that it may be advantageous to distribute the computational burden associated with the computation of the least one value of the objective perceptual quantity between two or more separate devices, in particular considering the constraints of computational and memory resources of a typical hearing instrument. The portable terminal may comprise a smartphone, a mobile phone or a tablet typically possessing significantly larger computational resources and memory resources than a typical hearing instrument. Hence, the first and second noisy speech segments may conveniently be stored or recorded in the data memory area of the portable terminal and the determination of the at least one value of the objective perceptual quantity of the noisy speech signal therefore carried out by a suitable signal processor, e.g. a microprocessor or DSP, of the portable terminal. An alternative embodiment of the hearing aid system comprises a second hearing instrument instead of the portable terminal and may therefore provide a binaural hearing aid system where the first hearing instrument is arranged at, or in, the user's left or right ear and the second hearing instrument placed at, or in, the user's other ear.

The wireless communication link may be based on RF signal transmission e.g. analog FM technology or various types of digital transmission technology for example complying with one of the Bluetooth standards, such as Bluetooth LE, or other standardized RF communication protocols. In the alternative, the wireless communication link may be based on optical signal transmission or near-field inductive coupling.

A method of determining an objective perceptual quantity of a noisy speech signal using directional sound information, includes: applying a noisy speech signal comprising a mixture of target speech and interfering noise to a first hearing instrument, wherein the first hearing instrument comprises an adjustable microphone arrangement; controlling the adjustable microphone arrangement to produce a first directivity pattern having a first directivity index; recording a first noisy speech segment generated by the adjustable microphone arrangement using the first directivity pattern; controlling the adjustable microphone arrangement to produce a second directivity pattern having a second directivity index, wherein the second directivity index is smaller than the first directivity index at one or more reference frequencies; recording a second noisy speech segment generated by the adjustable microphone arrangement using the second directivity pattern; and determining at least one value of the objective perceptual quantity of the noisy speech signal by a signal processor by comparing the first noisy speech segment and the second noisy speech segment.

Optionally, the objective perceptual quantity comprises one or more of: a speech intelligibility measure and a speech quality measure.

Optionally, the speech intelligibility measure comprises a standardized objective intelligibility measure.

Optionally, the speech quality measure comprises a standardized objective speech quality measure.

Optionally, the method further includes (a) activating or deactivating at least one signal processing algorithm running on a hearing aid signal processor based on the at least one value of the objective perceptual quantity, and/or (b) adjusting a parameter value of the at least one signal processing algorithm based on the at least one value of the objective perceptual quantity; wherein the method further comprises: processing a microphone signal generated by the adjustable microphone arrangement in accordance with an active signal processing algorithm and/or the adjusted parameter value to produce a first hearing loss compensated output signal of the hearing instrument; and presenting the first hearing loss compensated output signal to a left or right ear of a user through a first output transducer.

Optionally, the method further includes gradually adjusting the parameter value of the at least one signal processing algorithm in accordance with values of the objective perceptual quantity.

Optionally, the at least one signal processing algorithm comprises: an adjustable beamforming algorithm, an adaptive feedback cancellation algorithm, a single-channel noise reduction algorithm, a multi-channel noise reduction algorithm, or a multi-channel dynamic range compression algorithm.

Optionally, the method further includes: transmitting the first noisy speech segment and the second noisy speech segment from the first hearing instrument to a stationary terminal, a portable terminal, or a second hearing instrument via a wireless communication link; and recording the first noisy speech segment and the second noisy speech segment in a data memory of the stationary terminal, the portable terminal, or the second hearing instrument; wherein the signal processor is at the stationary terminal, the portable terminal, or the second hearing instrument, and wherein the at least one value of the objective perceptual quantity of the noisy speech signal is determined by the signal processor at the stationary terminal, the portable terminal, or the second hearing instrument; and wherein the method further comprises transmitting the at least one value of the objective perceptual quantity from the stationary terminal, the portable terminal, or the second hearing instrument to the first hearing instrument via the wireless communication link.

Optionally, the method further includes recording the first noisy speech segment and the second noisy speech segment in a data memory of the first hearing instrument.

Optionally, the second directivity index is smaller than 2 dB at 1 kHz, and the first directivity index is larger than 4 dB at 1 kHz.

Optionally, the second directivity index is smaller than 2 dB between 500 Hz and 3 kHz, and the first directivity index is larger than 4 dB between 500 Hz and 3 kHz.

Optionally, the second directivity index is smaller than the first directivity index throughout a predetermined speech frequency range.

A hearing instrument includes: a hearing aid housing or shell configured for placement at, or in, a user's left or right ear; an adjustable microphone arrangement configured for generating a microphone signal in response to incoming sound from a sound field surrounding the hearing instrument, where the incoming sound comprises a noisy speech signal having a mixture of target speech and interfering noise; and a hearing aid signal processor configured for: controlling the adjustable microphone arrangement to produce a first directivity pattern having a first directivity index, recording, in a data memory, a first noisy speech segment generated by the adjustable microphone arrangement using the first directivity pattern, controlling the adjustable microphone arrangement to produce a second directivity pattern having a second directivity index, wherein the second directivity index is smaller than the first directivity index at one or more reference frequencies, recording, in the data memory, a second noisy speech segment generated by the adjustable microphone arrangement using the second directivity pattern, and determining at least one value of an objective perceptual quantity of the noisy speech signal by comparing the first noisy speech segment and the second noisy speech segment.

Optionally, the adjustable microphone arrangement at least comprises (a) a first omnidirectional microphone and a second omnidirectional microphone, or (b) an omnidirectional microphone and a directional microphone.

A hearing aid system comprising (a) a first hearing instrument and (b) a stationary terminal, a portable terminal, or a second hearing instrument, the first hearing instrument includes: a hearing aid housing or shell configured for placement at, or in, a user's left or right ear; an adjustable microphone arrangement configured for generating a microphone signal in response to incoming sound from a sound field surrounding the first hearing instrument, where the incoming sound comprises a noisy speech signal having a mixture of target speech and interfering noise; a hearing aid signal processor configured for: controlling the adjustable microphone arrangement to produce a first directivity pattern having a first directivity index, receiving a first noisy speech segment generated by the adjustable microphone arrangement using the first directivity pattern, controlling the adjustable microphone arrangement to produce a second directivity pattern having a second directivity index, wherein the second directivity index is smaller than the first directivity index at one or more reference frequencies, receiving a second noisy speech segment generated by the adjustable microphone arrangement using the second directivity pattern; and a wireless transmitter configured to transmit the first noisy speech segment and the second noisy speech segment to the stationary terminal, the portable terminal, or the second hearing instrument via a wireless communication link; wherein the stationary terminal, the portable terminal, or the second hearing instrument comprises a wireless transceiver configured to transmit and receive data through the wireless communication link, and a signal processor configured to: recording the first noisy speech segment and the second noisy speech segment in a data memory area of the stationary terminal, the portable terminal, or the second hearing instrument, determining at least one value of an objective perceptual quantity of the noisy speech signal by comparing the first noisy speech segment and the second noisy speech segment, and transmitting the at least one value of the objective perceptual quantity from the stationary terminal, the portable terminal, or the second hearing instrument to the first hearing instrument via the wireless communication link.

Other and further aspects and features will be evident from reading the following detailed description of the embodiments.

BRIEF DESCRIPTION OF THE DRAWINGS

Embodiments will be described in more detail in connection with the appended drawings in which.

DESCRIPTION OF THE EMBODIMENTS

Figure 1:
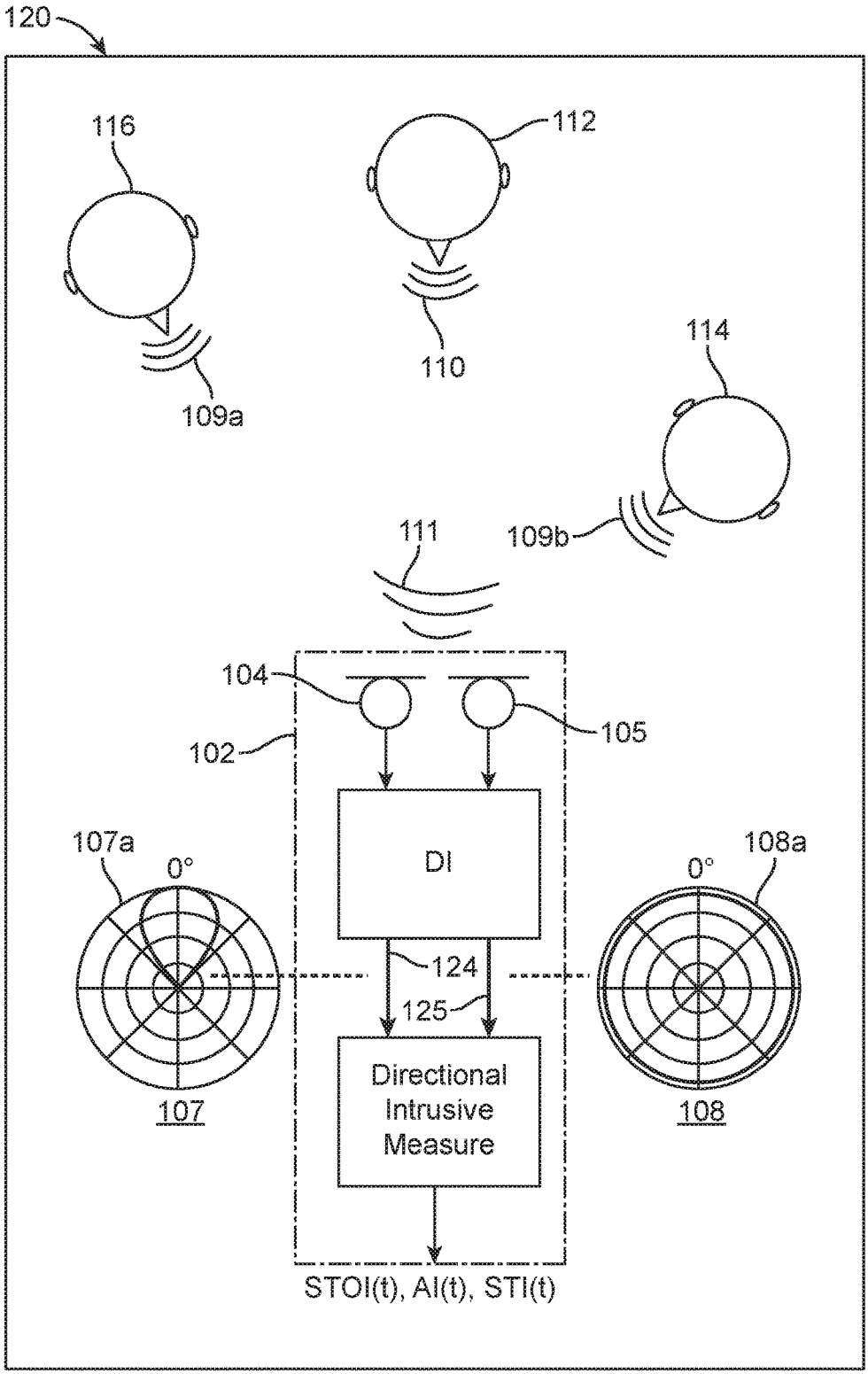
FIG. 1 is a schematic block diagram of a hearing instrument placed in a noisy listening environment comprising a target speaker and a number of interfering noise sources producing unwanted interfering speech signals at the microphone arrangement of the hearing instrument in accordance with a first embodiment.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

FIG. 1 is a schematic illustration of a hearing instrument 102, or a hearing instrument system 102 as discussed in further detail below, in accordance with a first embodiment operating in an adverse sound or listening environment. The hearing instrument 102 is configured to determine an objective perceptual quantity of a received noisy speech signal of the listening environment using directional sound information as discussed in further detail below. The hearing instrument 102 may comprise a housing or shell configured for placement at, or in, a hearing impaired individual's left or right ear (not shown). The skilled person will understand that the hearing instrument 102 may comprise different types of hearing instruments such as so-called BTE types, ITE types, CIC types, RIC types etc. Hence, the microphone arrangement of the hearing instrument may be located at various locations at, or in, the user's ear such as behind the user's pinnae, or inside the user's outer ear or inside the user's ear canal.

The hearing impaired individual (not shown) wishes to receive a target speech signal 110 or possibly other types of sound, produced by a target or desired speaker 112 who is placed some distance away from the hearing impaired individual 102 at or close to the latter's median plane. As schematically illustrated by interfering speech signals, or speech jammers, 109*a*, 109*b* generated by interfering speakers 114, 116, the sound environment surrounding the hearing impaired individual may be adverse and the noisy speech signal 111 at the location of a pair of omnidirectional microphones 104, 105 of an adjustable microphone arrangement of the hearing instrument 102 suffer from a low signal-to-noise (SNR). The interfering speech signals 109*a*, 109*b* generated by the interfering speakers 114, 116 therefore represent noise sources for the hearing aid user in the present listening environment and are likely to lower speech intelligibility of the target speech 110. The skilled person will understand that the noise signals 109*a*, 109*b* in practice may comprise many other types of common noise sources such as machine noise, wind noise, babble noise, speech and music from television and radio etc. instead of or in addition to interfering speech signals. The noise signals may in addition to direct noise sound components from the various noise sources also comprise various boundary reflections from room boundaries 120 of the room, hall or chamber where the hearing impaired individual is placed. The result of the presence of these interfering noise sources is that a noisy speech signal 111 is impinging on the pair of omnidirectional microphones 104, 105 and this noisy speech signal 111 comprises a mixture of the desired/target speech signal 110 and interfering speech signals 109*a*, 109*b*.

The hearing instrument 102 comprises an adjustable microphone arrangement 104, 105, directivity index configured for generating one or more microphone signal(s) in response to the incoming sound from the surrounding sound environment or sound field such as the noisy speech signal discussed above. The hearing instrument 102 further comprises a hearing aid signal processor (refer to item 240 on FIG. 2) configured to executing steps of controlling the adjustable microphone arrangement to produce a first predetermined directivity pattern 107*a* exhibiting a first directivity index. The directivity pattern 107*a* is schematically illustrated on graph 107 and exhibits a markedly directional nature with a main lobe pointing toward the target speaker 112 placed approximately at 0 degree direction. The first predetermined directivity pattern 107*a* may have been recorded at a relevant or suitable reference frequency within the speech frequency range, e.g. a reference frequency somewhere between 200 Hz and 5 kHz for example at 1 kHz. The first directivity index may be larger than 4 dB, or larger than 6 dB, or larger than 10 dB to provide good suppression of interfering noise from other directions than the one where the target speaker is located, e.g. frontal direction. The hearing aid signal processor is configured or programmed, for example via a suitable program routine or program thread, to record or store a first noisy speech segment generated by the adjustable microphone arrangement in response to the noisy speech signal 111 using the first predetermined directivity pattern. The first noisy speech segment may for example be stored in a suitable data memory area of a volatile or non-volatile memory of the hearing instrument 102 or any other suitable memory buffer. The length of the first noisy speech segment will vary depending on the nature of the objective perceptual quantity to be computed. In some embodiments, the objective perceptual quantity may be a speech intelligibility measure such as a standardized objective intelligibility measure for example a short-time objective intelligibility measure (STOI). In the latter situation the length of the first noisy speech segment may lie between 333 ms and 500 ms and the length of the second noisy speech segment may lie between 333 ms and 500 ms.

The adjustable microphone arrangement 104, 105, directivity index may comprise first and second analog-to-digital converters (not shown) configured to sample and digitize first and second analog omnidirectional microphone signals supplied by the first and second omnidirectional microphones 104, 105 so as to produce first and second digital microphone signals. Each of the first and second digital microphone signals may have a sampling frequency between 6 kHz and 48 kHz and a resolution between 12 and 24 bits.

The hearing aid signal processor may be configured to produce a directional microphone signal 125 possessing the first predetermined directivity pattern 107*a* by applying a suitable directional algorithm to the first and second digital microphone signals. The first predetermined directivity pattern 107*a* can be adjusted as desired in a highly flexible manner under the control of the hearing aid signal processor by the directional algorithm. The directional algorithm may comprise a delay and subtract function with a variable time delay between the first and second digital microphone signals. The adjustable microphone arrangement 104, 105, directivity index may furthermore produce a substantially omnidirectional microphone signal 124 possessing a second predetermined directivity pattern 108*a* in a simple manner by selecting just one of the first and second digital omnidirectional microphone signals for further processing.

However in accordance with alternative embodiments of the adjustable microphone arrangement 104, 105, the directivity index may rely on a combination of an omnidirectional microphone element and a directional microphone element where the latter comprises a traditional pressure gradient microphone having a pair of spaced apart sound ports leading to opposite sides of a common diaphragm. In the latter embodiment, the directional microphone signal 125 exhibiting the first predetermined directivity pattern 107*a* may be produced directly at the output of the directional microphone element while the substantially omnidirectional microphone signal 124 may be recorded directly from the output of the omnidirectional microphone element. Hence, the hearing aid signal processor can for example switch the adjustable microphone arrangement between the first and second predetermined directivity patterns 107*a*, 108*a* by switching between the microphone signals produced at the outputs of the directional and omnidirectional microphone elements.

After, or simultaneously with using parallel processing, the hearing aid signal processor records or stores the first noisy speech segment generated by the adjustable microphone arrangement using the first predetermined directivity pattern, the hearing aid signal processor controls the adjustable microphone arrangement to produce the previously discussed second predetermined directivity pattern 108*a*. The first directivity index is larger than the second directivity index at least at the previously discussed one or more reference frequencies or frequency ranges. The first directivity index may for example be at least 3 dB or 6 dB larger than the second directivity index at each of the one or more reference frequencies. The second directivity index may for example lie between 0 dB and 2 dB to provide nearly omnidirectional sound pick-up. The hearing aid signal processor records or stores, in a second address range of the data memory, a second noisy speech segment generated by the adjustable microphone arrangement using the second predetermined directivity pattern. The skilled person will understand that the first noisy speech segment and the second noisy speech segment may comprise substantially time-aligned sections of the noisy speech signal 111. In some embodiments, the first and second omnidirectional digital microphone signals may be temporarily stored in a suitable memory buffer of the hearing aid signal processor before being subjected to the previously discussed beamforming algorithm to form the directional microphone signal possessing the first predetermined directivity pattern 107*a*. A time-aligned omnidirectional microphone signal producing the second noisy speech segment may be formed by selecting one of the stored first and second omnidirectional digital microphone signals from the appropriate buffer location or address.

The hearing aid signal processor may subsequently retrieve the first noisy speech segment and the second noisy speech segment from the appropriate locations or addresses of the data memory and determine one or more values of the objective perceptual quantity of the noisy speech signal by comparing the first noisy speech segment and the second noisy speech segment. Thereafter, the hearing aid signal processor may flush the first noisy speech segment and the second noisy speech segment from the data memory and start computing a second or following value of the objective perceptual quantity by once again generating and forming a new pair of noisy speech segments from the noisy speech signal and compute the corresponding value of the objective perceptual quantity. In this manner, the hearing aid signal processor may be configured to regularly, e.g. at predefined time intervals such as the previously discussed frame size of 333 mm to 500 ms, produce updated values of the objective perceptual quantity reflecting the current properties of the noisy speech signal. A time delay between the start time of the first and second noisy speech segments and the delivery time of the corresponding value of the objective perceptual quantity may lie between 500 ms and 5 s and is preferably smaller than 4 s.

In the present embodiment, the hearing aid signal processor may be configured to compute the previously discussed short-time objective intelligibility (STOI) measure which is well-suited to compute accurate intelligibility scores of several types of speech signal degradation often encountered in hearing instruments such as additive noise, reverberation, filtering and clipping. However, the computation of STOI values requires access to both the noisy speech signal and the clean speech signal which means that this otherwise useful objective intelligibility measure has been considered unfit for online or live hearing instrument applications where only the noisy speech signal, as picked-up by the hearing aid microphone, is normally available for analysis. One or more embodiments described herein have solved this problem by producing a so-called "pseudo" clean speech signal replacing the unavailable "true" clean speech signal by exploiting spatially directional properties of the microphone arrangement of the hearing instrument. A marked suppression of the interfering speech signals 109*a*, 109*b*, and other noise sources present within the listening environment, in the first noisy speech segment is achieved by receiving or recording the first speech segment using the first predetermined directivity pattern 107*a* which may possess a relatively large directivity index, i.e. a narrow beam pattern, pointing towards the target speaker 112. Hence, while a finite residual level of interfering speech and other noise signals 109*a*, 109*b* may be present in the "pseudo" clean speech signal, this level may be sufficiently small to allow accurate estimation of the STOI values by appropriate selection or setting of the first directivity index as discussed in further detail below with reference to the experimental results obtained by the inventors.

The hearing instrument 102 may accordingly be adapted to continuously compute STOI values characterizing the intelligibility of the desired/target speech signal 110 at received at the microphone arrangement of the hearing instrument 102. STOI values close to 1.0 indicate perfect intelligibility of the desired/target speech signal 110 while STOI values close to 0.0 indicates zero speech intelligibility. The skilled person will appreciate that the computed STOI values may be utilized by the hearing aid signal processor in numerous ways to adapt the processing of the hearing loss compensated output signal supplied to the hearing aid user's left or right ear. The hearing aid signal processor may for example activate or deactivate certain signal processing algorithms in dependence of current STOI values. Alternatively, or additionally, the hearing aid signal processor may be adapted to adjusting a parameter value or values of the same signal processing algorithms without necessarily deactivating the algorithm.

As one example, the hearing aid signal processor may for example deactivate a single-channel noise reduction algorithm when a current STOI value lies above a predetermined threshold and activate the single-channel noise reduction algorithm when the current STOI value falls below the predetermined threshold. In this manner, the hearing user may benefit from the absence of audible sound artifacts of the hearing loss compensated output signal introduced by the active single-channel noise reduction algorithm in sound environments where the intelligibility of the desired/target speech signal 110 is sufficiently high to allow the hearing aid user to understand incoming speech and communicate without difficulty. Under the opposite listening conditions suffering from a considerable level of interfering speech and noise as indicated by current STOI values below the predetermined threshold, the hearing aid signal processor may activate the single-channel noise reduction algorithm because the hearing aid user is able to benefit from the resulting noise reduction by improved intelligibility of the desired/target speech signal 110 despite the introduction of certain audible sound artifacts in the hearing loss compensated output signal.

The skilled person will understand that, following the same line of logic, the hearing aid signal processor may be adapted activate/deactivate numerous other types of signal processing algorithms, or adjusting parameter values of the same, depending on current values of the objective perceptual quantity in question for example a multi-channel dynamic range compression algorithm, a beamforming algorithm or a feedback cancellation algorithm. In this manner, the number of advanced signal processing algorithms applied to the hearing loss compensated output signal may be adapted to track the adverseness of the hearing aid user's listening or sound environment. This tracking may be carried out such that only a minimum amount of signal processing is applied to the target speech signal by the hearing aid signal processor under favorable listening conditions, i.e. those characterized by a low level of interfering speech and/or noise leading to a relatively high STOI value. A corresponding effect may of course often be achieved by adjusting certain parameter values of the active signal processing algorithms to increase or decrease the impact that a particular algorithm imparts to the hearing loss compensated output signal instead of deactivating the signal processing algorithms.

According to one exemplary embodiment, the STOI values determined or computed from the first and second noisy speech segments of the noisy microphone signal are used to control the directivity pattern of the microphone arrangement via an adjustable beamforming algorithm. In response to high STOI values close to 1, the hearing aid signal processor adapts the adjustable beamforming algorithm to produce a largely omnidirectional directivity pattern for example as the illustrated directivity pattern 108*a*. This may be achieved by simply disconnecting one of the two omnidirectional microphones 104, 105 or by adjusting a particular parameter such as the intra-microphone time delay or phase difference, of the adjustable beamforming algorithm. In response to declining STOI values for example moving towards zero, the hearing aid signal processor adapts the adjustable beamforming algorithm to produce a gradually more directional directivity pattern, i.e. increasing directivity index values. The directivity index values may be adjusted to conform to the directivity pattern 107*a* illustrated on polar plot 107 for STOI values close to 0.1. The latter directivity pattern may be a cardioid or hyper cardioid directivity pattern or any other suitable directivity pattern providing good suppression of off-center sound sources where center means sound sources at approximately 0 degree azimuth, or orientation, on the polar plots 107, 108. The maximum amount of achievable directivity will, however, also depend on the physical characteristics of the microphone arrangement, in particular the number of individual microphones therein and spacing between individual microphone sound ports.

Figure 2:
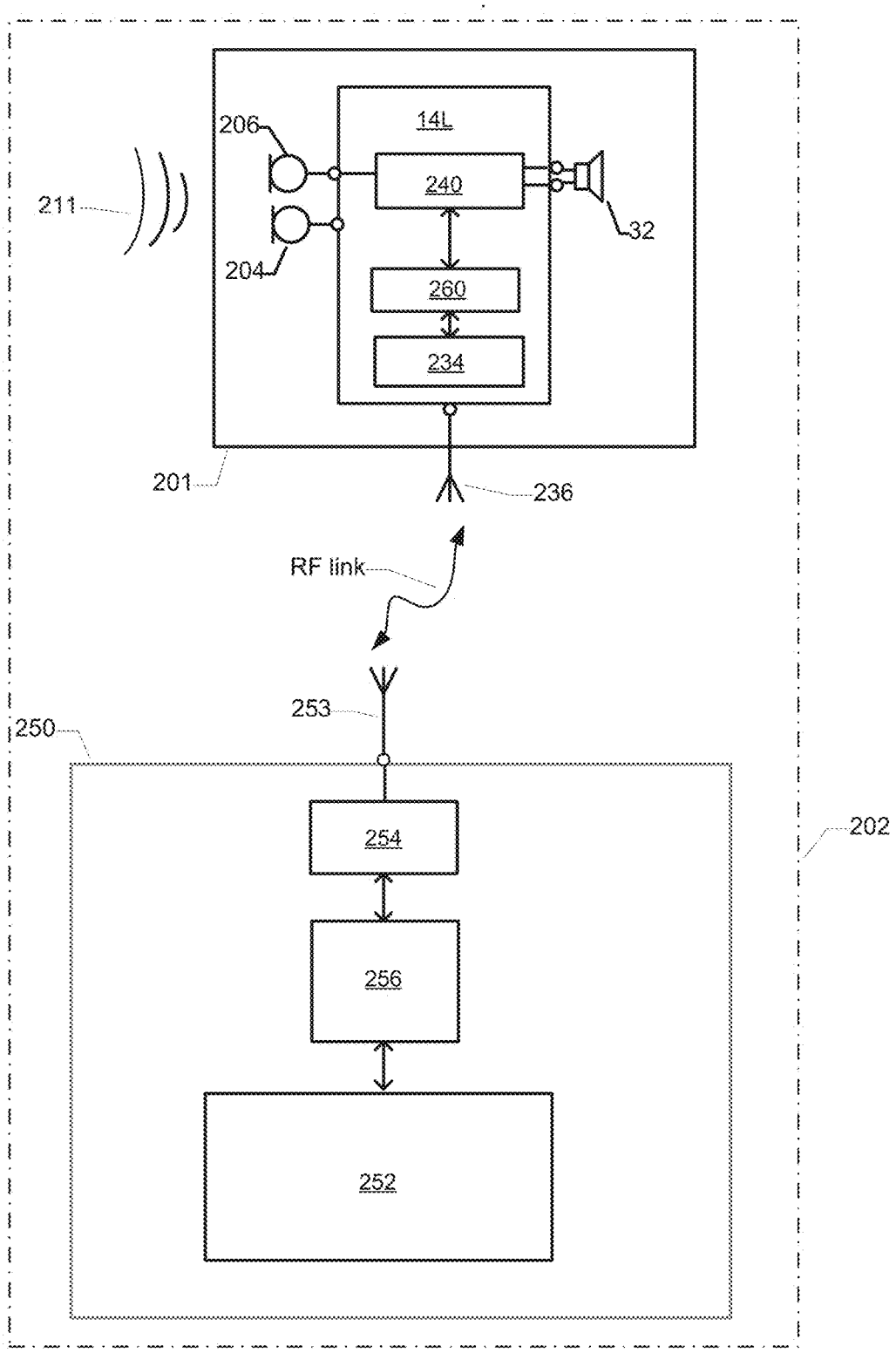
FIG. 2 is a schematic block diagram of an exemplary hearing aid system in accordance with a second embodiment.

The skilled person will understand that the capture of the first and second noisy speech segments of the noisy speech signal via the incoming microphone signal 111 and the subsequent computation of the value or values of the objective perceptual quantity in question of the noisy speech signal, such as the above-discussed STOI values, may be carried out exclusively by the hearing aid signal processor of the hearing instrument 102 in some embodiments as schematically illustrated above. However, in other embodiments, the capture of the first and second noisy speech segments of the noisy speech signal and the various storage and signal processing functions applied to the first and second noisy speech segments, as outlined above, may be distributed between two separate portable devices. The two separate portable devices form in conjunction a hearing aid apparatus or system carrying out/implementing the present methodology of determining the objective perceptual quantity of the noisy speech signal. Such a hearing aid system may, as schematically illustrated in FIG. 2, comprise a first hearing instrument 201 and a portable terminal 250 connected to each other via a bi-directional wireless data communication link, RF link. The portable terminal 250 may comprise a mobile phone, smartphone, tablet, or similar battery powered portable communication terminal. Other embodiments of the hearing aid system 202 may comprise a second hearing instrument (not shown) wirelessly connected to the first hearing instrument 201 so as to form a binaural hearing aid system.

The first hearing instrument or aid 201 of the hearing aid system 202 may be largely identical to the previously discussed hearing instrument 102 except for the addition of a wireless communication interface comprising a wireless receiver or transceiver 234, a communication controller 260 and an RF antenna 236. The wireless communication interface allows the first hearing instrument 201 to transmit wireless data, in particular data comprising the previously discussed first and second noisy speech segments, to the portable terminal 250. The first and second noisy speech segments may be modulated and transmitted as an analog signal or as a digitally encoded data via the wireless communication link. The wireless communication link may be based on RF signal transmission, e.g. FM technology or digital transmission technology for example complying with a Bluetooth standard or other standardized RF communication protocols. In the alternative, the wireless communication link may be based on optical signal transmission or near-field magnetic coupling.

As schematically illustrated, the portable terminal 250 comprises a second wireless transceiver 254 configured to transmit and receive data such as the first and second noisy speech segments through the wireless communication link. The portable terminal 250 comprises a signal processor 252 and a data memory 256. The signal processor 252 and data memory 256 may be integrated on a single semiconductor die. The data memory 256 may comprise different types of memory such as non-volatile EEPROM or volatile RAM memory. The signal processor 252 may comprise a software programmable microprocessor such that the below discussed functions are implemented by executable program instructions of one or more program routines executed on the signal processor 252. The signal processor 252 is preferably configured to write the first noisy speech segment and the second noisy speech segment to a predetermined memory area or address of the data memory 256. The signal processor 252 is preferably further configured to determining the previously discussed STOI value or values, or any other objective perceptual quantity of the noisy speech signal. The signal processor 252 may retrieve or read the first noisy speech segment and the second noisy speech segment from data memory 256 and performs the correlation of the first and second noisy speech segments following the standard for intrusive STOI calculation. The signal processor 252 thereafter transmits the computed STOI value or values back to the first hearing instrument 201 via the wireless communication link and RF antenna 253. The hearing aid signal processor 240 reads the received STOI value or values and may utilize these to perform the previously discussed activation/deactivation of various types of signal processing algorithms or to adjust parameter values of the same.

Figure 3:
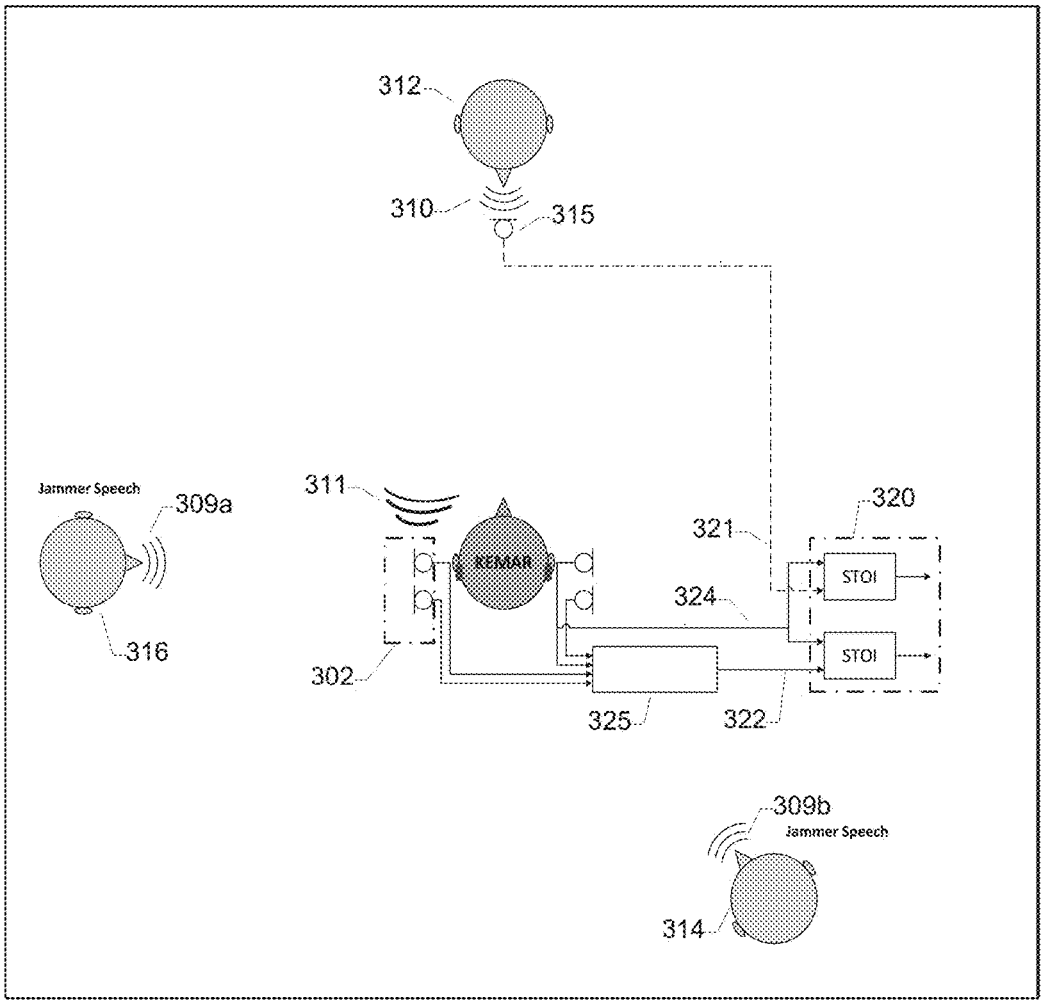
FIG. 3 is a simplified schematic illustration of a laboratory measurement set-up for testing and evaluating the present methodology of determining objective perceptual quantities of a noisy speech signal using directional sound information.

FIG. 3 is a simplified schematic illustration of a laboratory measurement set-up for testing the above-discussed methodology of determining the STOI values of the noisy speech signal. A test hearing instrument 302 with an adjustable microphone arrangement, which instrument may be similar to the previously discussed hearing instrument 102, is mounted on or at a left ear of a suitable head and torso simulator, such as HATS or KEMAR, simulating average acoustic properties of the human head and torso. A target or desired speaker 312 is placed some distance away from the KEMAR (simulating the hearing impaired user) at or close to the latter's median plane, i.e. substantially 0 degree azimuth. The sound environment surrounding KEMAR and test hearing instrument 302 comprises in addition to the target speaker 312 a first interfering speaker 314 placed at about 140 degrees azimuth and generating a first interfering speech signal 309*b* and a second interfering speaker 316 is placed at about 270 degrees azimuth and generating a second interfering speech signal 309*a*.

The experiment utilizes one embodiment of the present methodology for determining STOI values of the noisy speech signal 311 at the adjustable microphone arrangement of the hearing instrument 302 by relying on the previously discussed "pseudo" clean speech signal obtained through exploitation of spatially directional or selective properties of the adjustable microphone arrangement 302. The microphone arrangement is initially adjusted to produce a first predetermined directivity pattern with a relatively high directivity index as discussed before to attenuate or suppress components of the first and second interfering speech signals 309*a*, 309*b* to the extent possible. The first predetermined directivity pattern is produce by a beamforming module or function 325 in the experimental set-up. A "pseudo" clean speech segment is thereafter obtained from the noisy speech signal 311 by the directional properties of the microphone arrangement 302. The "pseudo" clean speech segment is recorded via input 322 of the STOI computation unit or device 320. The latter may comprise an electrical interface device coupled to a personal computer running a suitable MATLAB program for performing the STOI calculations. A near-field microphone 315 is arranged adjacent to the target speaker 312 to simultaneously record a "true" clean target speech signal 310, i.e. a reference signal, and transmits the latter to the STOI computation unit or device 320 via signal line 321. Finally, the microphone arrangement is adjusted to produce a second predetermined directivity pattern with a relatively small directivity index, for example smaller than 1 dB as discussed before, such that the first and second interfering speech signals 309*a*, 309*b* are rendered essentially unattenuated. A noisy speech segment is recorded from the noisy speech signal 311 via input 324 of the STOI computation unit or device 320. The "true" clean speech segment derived from the target speech signal 310 is correlated with the noisy speech segment derived from the noisy speech signal 311 and the STOI value computed and mapped to graph 400 of FIG. 4. The "pseudo" clean speech segment is likewise correlated with the noisy speech segment and the corresponding STOI value computed and mapped to graph 400 of FIG. 4. The reference curve or plot 403 of graph 400 shows experimentally measured and computed STOI values of the noisy speech signal 311 using the "true" clean speech segment for a broad range of signal-to-noise ratios of the noisy speech signal 311 between −20 dB and +20 dB. The beam-formed signal plot 405 of graph 400 shows the corresponding experimentally measured and computed STOI values of the noisy speech signal 311 using the "pseudo" clean speech segment for correlation instead of the "true" clean speech segment. As expected, the STOI values approach 1.0 for both test cases when the signal-to-noise ratio of the noisy speech signal 311 is sufficiently high e.g. at or above +20 dB. There is evidently a relatively good conformance between the experimentally determined STOI values obtained by using the "pseudo" clean speech segment and those obtained by use of the "true" clean speech segment obtained from the reference microphone directly at the target speaker's mouth.

Figure 4:
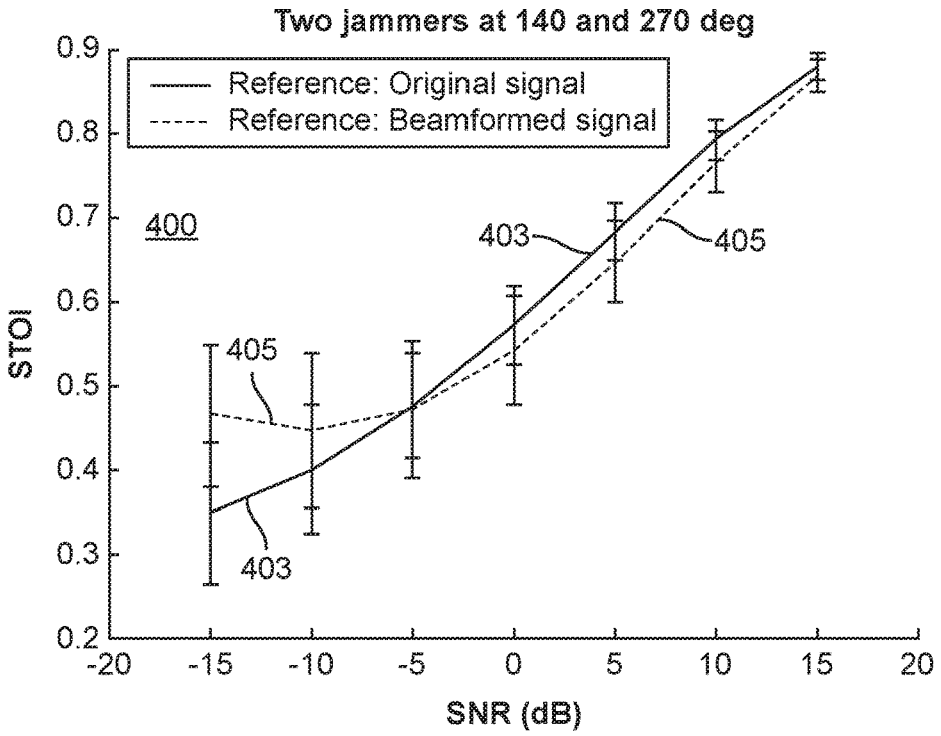
FIG. 4 shows experimentally measured STOI values under several signal-to-noise ratio conditions of a noisy speech signal obtained from the hearing instrument of the above-mentioned laboratory measurement set-up.
Figure 4:
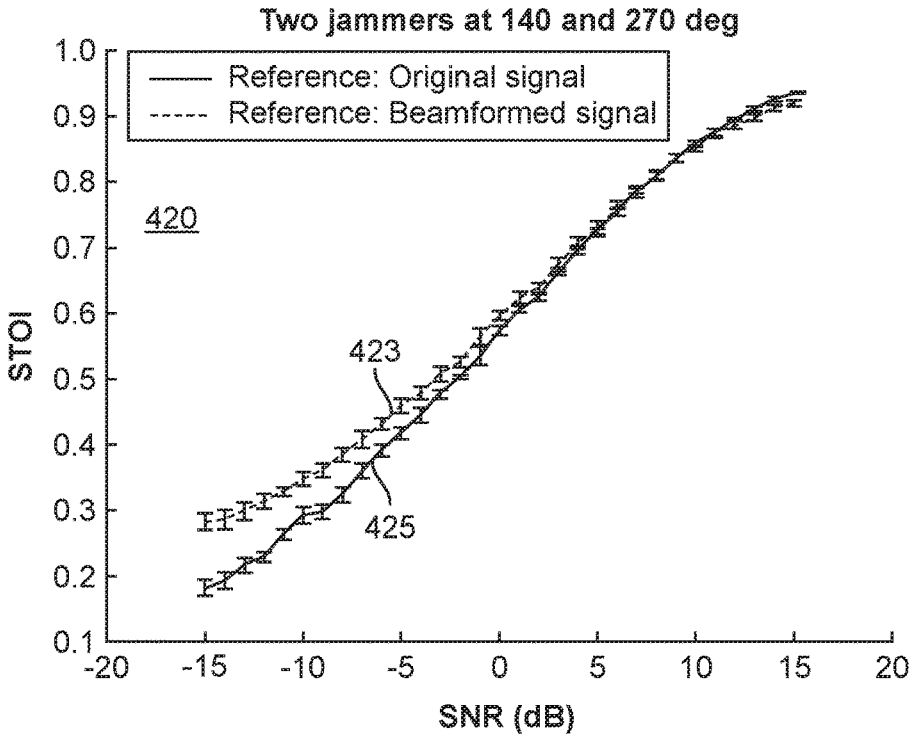

The plots 423, 425 of the lowermost graph 420 of FIG. 4 shows measured and computed STOI values for the same measurement set-up (FIG. 3) but using a pair of broad-band noise sources as interfering noise sources, or jammers, instead of the pair of speech interferer 309*a*, 309*b* used for the plots 403, 405 of graph 400.

Although particular embodiments have been shown and described, it will be understood that they are not intended to limit the claimed inventions, and it will be obvious to those skilled in the art that various changes and modifications may be made without departing from the spirit and scope of the present inventions. The specification and drawings are, accordingly, to be regarded in an illustrative rather than restrictive sense. The present inventions are intended to cover alternatives, modifications, and equivalents, which may be included within the spirit and scope of the present inventions as defined by the claims.

The invention claimed is:

1. A method of determining an objective perceptual quantity of a noisy speech signal using directional sound information, comprising:

obtaining a noisy speech signal comprising a mixture of target speech and interfering noise by a first hearing instrument, wherein the first hearing instrument comprises a microphone arrangement;

obtaining, from the microphone arrangement, (1) a first noisy speech segment associated with a first directivity pattern having a first directivity index and (2) a second noisy speech segment associated with a second directivity pattern having a second directivity index, the second directivity pattern being different from the first directivity pattern, wherein the second directivity index is smaller than the first directivity index at one or more reference frequencies;

recording the first noisy speech segment that is associated with the first directivity pattern;

recording the second noisy speech segment that is associated with the second directivity pattern; and determining at least one value of the objective perceptual quantity of the noisy speech signal by a signal processor by comparing the first noisy speech segment and the second noisy speech segment;

wherein the objective perceptual quantity comprises a speech intelligibility measure.

2. The method according to claim 1, wherein the objective perceptual quantity also comprises a speech quality measure.

3. The method according to claim 2, wherein the speech quality measure comprises a standardized objective speech quality measure.

4. The method according to claim 1, wherein the speech intelligibility measure comprises a standardized objective intelligibility measure.

5. The method according to claim 1, further comprising (a) activating or deactivating at least one signal processing algorithm running on a hearing aid signal processor based on the at least one value of the objective perceptual quantity, and/or (b) adjusting a parameter value of the at least one signal processing algorithm based on the at least one value of the objective perceptual quantity;

wherein the method further comprises:

processing a microphone signal generated by the microphone arrangement in accordance with an active signal processing algorithm and/or the adjusted parameter value to produce a first hearing loss compensated output signal of the hearing instrument; and presenting the first hearing loss compensated output signal to a left or right ear of a user through a first output transducer.

6. The method according to claim 5, further comprising gradually adjusting the parameter value of the at least one signal processing algorithm in accordance with values of the objective perceptual quantity.

7. The method according to claim 5, wherein the at least one signal processing algorithm comprises: an adjustable beamforming algorithm, an adaptive feedback cancellation algorithm, a single-channel noise reduction algorithm, a multi-channel noise reduction algorithm, or a multi-channel dynamic range compression algorithm.

8. The method according to claim 1, further comprising:

transmitting the first noisy speech segment and the second noisy speech segment from the first hearing instrument to a stationary terminal, a portable terminal, or a second hearing instrument via a wireless communication link; and recording the first noisy speech segment and the second noisy speech segment in a data memory of the stationary terminal, the portable terminal, or the second hearing instrument;

wherein the signal processor is at the stationary terminal, the portable terminal, or the second hearing instrument, and wherein the at least one value of the objective perceptual quantity of the noisy speech signal is determined by the signal processor at the stationary terminal, the portable terminal, or the second hearing instrument; and wherein the method further comprises transmitting the at least one value of the objective perceptual quantity from the stationary terminal, the portable terminal, or the second hearing instrument to the first hearing instrument via the wireless communication link.

9. The method according to claim 1, wherein the first noisy speech segment and the second noisy speech segment are recorded in a data memory of the first hearing instrument.

10. The method according to claim 1, wherein the second directivity index is smaller than 2 dB at 1 kHz, and the first directivity index is larger than 4 dB at 1 kHz.

11. The method according to claim 1, wherein the second directivity index is smaller than 2 dB between 500 Hz and 3 kHz, and the first directivity index is larger than 4 dB between 500 Hz and 3 kHz.

12. The method according to claim 1, wherein the second directivity index is smaller than the first directivity index throughout a predetermined speech frequency range.

13. The method according to claim 1, wherein the microphone arrangement comprises an omnidirectional microphone and a directional microphone.

14. A hearing instrument comprising:

a hearing aid housing or shell configured for placement at, or in, a user's left or right ear;

a microphone arrangement configured for generating a microphone signal in response to incoming sound from a sound field surrounding the hearing instrument, where the incoming sound comprises a noisy speech signal having a mixture of target speech and interfering noise; and a hearing aid signal processor configured for:

obtaining, from the microphone arrangement, (1) a first noisy speech segment associated with a first directivity pattern having a first directivity index and (2) a second noisy speech segment associated with a second directivity pattern having a second directivity index, the second directivity pattern being different from the first directivity pattern, wherein the second directivity index is smaller than the first directivity index at one or more reference frequencies, recording, in a data memory, the first noisy speech segment that is associated with the first directivity pattern, recording, in the data memory, the second noisy speech segment that is associated with the second directivity pattern, and determining at least one value of an objective perceptual quantity of the noisy speech signal by comparing the first noisy speech segment and the second noisy speech segment;

wherein the objective perceptual quantity comprises a speech intelligibility measure.

15. The hearing instrument according to claim 14, wherein the microphone arrangement at least comprises (a) a first omnidirectional microphone and a second omnidirectional microphone, or (b) an omnidirectional microphone and a directional microphone.

16. A hearing aid system comprising (a) a first hearing instrument and (b) a stationary terminal, a portable terminal, or a second hearing instrument, the first hearing instrument comprising:

a hearing aid housing or shell configured for placement at, or in, a user's left or right ear;

a microphone arrangement configured for generating a microphone signal in response to incoming sound from a sound field surrounding the first hearing instrument, where the incoming sound comprises a noisy speech signal having a mixture of target speech and interfering noise;

a hearing aid signal processor configured for:

obtaining, from the microphone arrangement, a first noisy speech segment associated with a first directivity pattern having a first directivity index, and obtaining, from the microphone arrangement, a second noisy speech segment associated with a second directivity pattern having a second directivity index, the second directivity pattern being different from the first directivity pattern, wherein the second directivity index is smaller than the first directivity index at one or more reference frequencies; and a wireless transmitter configured to transmit the first noisy speech segment and the second noisy speech segment to the stationary terminal, the portable terminal, or the second hearing instrument via a wireless communication link;

wherein the stationary terminal, the portable terminal, or the second hearing instrument comprises a wireless transceiver configured to transmit and receive data through the wireless communication link, and a signal processor configured for:

recording the first noisy speech segment and the second noisy speech segment in a data memory area of the stationary terminal, the portable terminal, or the second hearing instrument, determining at least one value of an objective perceptual quantity of the noisy speech signal by comparing the first noisy speech segment and the second noisy speech segment, and transmitting the at least one value of the objective perceptual quantity from the stationary terminal, the portable terminal, or the second hearing instrument to the first hearing instrument via the wireless communication link; and wherein the objective perceptual quantity comprises a speech intelligibility measure.

17. The hearing aid system according to claim 16, wherein the objective perceptual quantity also comprises a speech quality measure.

18. The hearing aid system according to claim 16, wherein the second directivity index is smaller than 2 dB at 1 kHz, and the first directivity index is larger than 4 dB at 1 kHz.

19. The hearing aid system according to claim 16, wherein the second directivity index is smaller than 2 dB between 500 Hz and 3 kHz, and the first directivity index is larger than 4 dB between 500 Hz and 3 kHz.

20. The hearing aid system according to claim 16, wherein the microphone arrangement comprises an omnidirectional microphone and a directional microphone.

* * * * *